US009960541B2

(12) United States Patent
Atkinson et al.

(10) Patent No.: US 9,960,541 B2
(45) Date of Patent: May 1, 2018

(54) SUBSEA CONNECTOR

(71) Applicant: Siemens Aktiengesellschaft, Munich (DE)

(72) Inventors: Chris Atkinson, Ulverston (GB); Wesley Barrett, Kendal (GB); Ross Carrington, Kendal (GB); Kevin Higgs, Ulverston (GB); Mark Santos, Ulverston (GB)

(73) Assignee: Siemens Aktiengesellschaft, Munich (DE)

( * ) Notice: Subject to any disclaimer, the term of this patent is extended or adjusted under 35 U.S.C. 154(b) by 0 days. days.

(21) Appl. No.: 15/160,135

(22) Filed: May 20, 2016

(65) Prior Publication Data

US 2016/0365675 A1 Dec. 15, 2016

(30) Foreign Application Priority Data

Jun. 12, 2015 (EP) ..... 15171875

(51) Int. Cl.

| | |
|---|---|
| ***H01R 13/648*** | (2006.01) |
| ***H01R 13/652*** | (2006.01) |
| ***H01R 4/48*** | (2006.01) |
| ***H01R 4/64*** | (2006.01) |
| ***H01R 13/523*** | (2006.01) |
| ***H01R 13/6592*** | (2011.01) |
| *H01R 13/187* | (2006.01) |

(52) U.S. Cl.

CPC ..... *H01R 13/652* (2013.01); *H01R 4/4881* (2013.01); *H01R 4/643* (2013.01); *H01R 13/523* (2013.01); *H01R 13/6592* (2013.01); *H01R 13/187* (2013.01)

(58) Field of Classification Search

CPC ..... H01R 13/648; H01R 13/658; H01R 4/64; H01R 4/646; H01R 9/0524; H01R 4/24; H01R 4/2475; H01R 4/66; H01R 13/5205; H01R 9/032; H01R 9/0527

USPC ..... 439/98, 99, 607.34, 607.44

See application file for complete search history.

(56) References Cited

U.S. PATENT DOCUMENTS

| | | | | | |
|---|---|---|---|---|---|
| 3,739,076 | A | * | 6/1973 | Schwartz | H01R 13/648 174/665 |
| 3,777,050 | A | * | 12/1973 | Silva | H01R 4/646 174/73.1 |
| 3,830,957 | A | * | 8/1974 | Oberdiear | H01R 13/648 174/653 |
| 4,032,205 | A | * | 6/1977 | Taj | H02G 15/068 174/78 |

(Continued)

FOREIGN PATENT DOCUMENTS

| | | |
|---|---|---|
| CN | 203574173 U | 4/2014 |
| DE | 19841199 A1 | 3/2000 |
| DE | 10031101 A1 | 1/2002 |

*Primary Examiner* — Abdullah Riyami
*Assistant Examiner* — Vladimir Imas
(74) *Attorney, Agent, or Firm* — Beusse Wolter Sanks & Maire

(57) ABSTRACT

A subsea connector includes a recess arranged on an inner surface of the housing of the subsea connector. The recess is configured to receive a canted coil spring such that it provides an electrical multi-point contact between an outer shielding layer, sometimes referred to as a screen, of a subsea cable. The subsea connector further includes a link configured to releasably attach an earth link wire to the housing.

20 Claims, 7 Drawing Sheets

(56) References Cited

U.S. PATENT DOCUMENTS 4,142,770 A * 3/1979 Butler, Jr. ..... H01R 13/523 439/140
4,164,621 A * 8/1979 Silva ..... H02G 15/105 156/49
4,236,779 A * 12/1980 Tang ..... H01R 13/6592 439/580
4,252,388 A * 2/1981 Brady ..... H01R 39/00 439/24
4,295,665 A * 10/1981 Pierce ..... E21B 33/043 285/123.2
4,469,172 A * 9/1984 Clark ..... E21B 33/04 166/115
4,547,623 A * 10/1985 Van Brunt ..... H01R 4/646 174/359
4,565,417 A * 1/1986 Dussel ..... H01R 13/52 439/108
4,579,405 A * 4/1986 Hirooka ..... H01R 9/2491 439/106
4,669,792 A * 6/1987 Kjeldstad ..... H01R 13/523 439/190
4,790,765 A * 12/1988 Ehrenfels ..... H01R 9/037 439/799
4,852,648 A * 8/1989 Akkerman ..... E21B 17/003 166/66.4
4,965,410 A * 10/1990 Spector ..... H01R 4/723 174/77 R
5,194,012 A * 3/1993 Cairns ..... H01R 13/523 439/201
5,459,812 A * 10/1995 Taylor ..... H05B 3/82 392/498
5,466,890 A * 11/1995 Stagnitti ..... H01R 4/60 174/12 BH
5,906,513 A * 5/1999 Peterson ..... H01R 9/032 439/320
6,040,527 A * 3/2000 De Buyst ..... H02G 15/103 174/88 C
6,554,636 B2 * 4/2003 Walker ..... H01R 13/523 174/86
6,583,352 B2 * 6/2003 Fukushima ..... H01R 9/032 174/373
6,669,511 B1 * 12/2003 Yagi ..... H01R 4/646 439/607.44
6,793,532 B2 * 9/2004 Saito ..... H01R 9/0518 174/360
6,905,360 B2 * 6/2005 Berger ..... H01R 13/741 439/441
7,211,732 B2 * 5/2007 Yagi ..... H01R 13/5205 174/74 R
7,373,054 B2 * 5/2008 Stix ..... G02B 6/3816 385/100
7,393,218 B1 * 7/2008 Pavlovic ..... H01R 4/646 439/939
7,976,320 B2 * 7/2011 Nishimura ..... H01R 13/502 439/607.34
8,028,930 B2 * 10/2011 Ehlert ..... F02M 47/027 123/531
8,602,797 B2 * 12/2013 Omae ..... H01R 9/0518 439/99
8,777,643 B2 * 7/2014 De France ..... H01R 4/46 174/78
8,808,012 B2 * 8/2014 Omae ..... H01R 4/646 439/98
8,851,939 B2 * 10/2014 Bazenas ..... H01R 13/111 439/840
9,059,534 B2 * 6/2015 Endo ..... H01R 13/5205
9,391,389 B2 * 7/2016 Ohmori ..... H01R 24/52
2008/0003851 A1 * 1/2008 Ainceri ..... H01R 4/20 439/125
2010/0029145 A1 * 2/2010 Balsells ..... H01R 13/03 439/827
2012/0003880 A1 * 1/2012 Glick ..... H01R 13/187 439/786
2012/0003884 A1 * 1/2012 Lampert ..... H01R 13/17 439/884

* cited by examiner

SUBSEA CONNECTOR

CROSS REFERENCE TO RELATED APPLICATIONS

This application claims the benefit of European Application No. EP15171875 filed 12 Jun. 2015, incorporated by reference herein in its entirety.

TECHNICAL FIELD

Various embodiments of the invention relate to a subsea connector comprising a housing and a recess arranged on an inner surface of the housing. The recess is configured to receive a canted coil spring such that it provides an electrical multi-point contact to an outer shielding layer of a subsea cable.

BACKGROUND

Typically, subsea systems utilize high voltage subsea cables to electrically connect subsea equipment. Often, subsea cables comprise an outer shielding layer. Some types of outer shielding layers allow controlling dielectric stress on the cable insulation of the subsea cable; then, the outer shielding layer is sometimes referred to as screen. Typical examples of outer shielding layers comprise a foil wrap, copper tape, multi-strand braid, a solid lead layer, metallic material, or semi-conductive material. For effective operation, the outer shielding layer is connected to Ground (Earth) via an earth link wire.

Establishing the electrical connection between the earth link wire and the outer shielding layer can be challenging. This is due to the ductile nature and plastic deformation properties of the material thereof.

Different reference implementations of establishing the electrical connection between the earth link wire and the outer shielding layer exist.

One example of establishing such an electrical connection by means of a subsea connector 20 according to reference implementations is shown in FIG. 1. Here, the earth link wire 121 is held an electrical connection with the outer shielding layer 112 of the subsea cable 111 by trapping the earth link wire 121 within windings or revolutions of a constant force coil 191. A so-called earth breakout boot 192 protects the connector 20 against environmental influences.

However, such techniques face certain drawbacks. E.g., while the constant force coil 191 can accommodate changes in the diameter of the subsea cable 111 to a certain extent, movement of the subsea cable 111 can cause friction in between the outer shielding layer 112 and the constant force coil 191. Abrasion or chaffing of the outer shielding layer 112 may result. Further, the earth breakout boot 192 may be susceptible to air entrapment. Air entrapment can cause distortions to the outer shielding layer 112 due to differential pressure within the connector 20 during operation. Furthermore, where a plurality of subsea cables 111 is arranged in the vicinity of each other—e.g., in order to connect to one and the same subsea equipment at a given position—it is possible that the significant outer dimensions of the connector 20 require splaying of the subsea cables 20 with respect to each other. Then, a flexibility in the arrangement of the subsea cables is typically limited.

In a further reference implementation, the electrical connection between the earth link wire 121 and the outer shielding layer 112 is provided by techniques such as soldering; the corresponding connector 20 is shown in FIG. 2. Here, a solder ring is formed by solder wire 193. The earth link wire 121 is soldered to the solder wire 193.

However, such techniques as explained above face certain drawbacks. E.g., the connection formed by soldering may have limited durability. E.g., due to cable manipulation in the assembly process and/or due to thermal expansion/contraction, stress can be induced in the corresponding connector causing failure. Again, it is possible that the earth breakout boot 192 is susceptible to air entrapment.

SUMMARY

Therefore, a need exists for advanced techniques of connecting an outer shielding layer of a subsea cable to an earth link wire. In particular, need exists for corresponding subsea connectors which provide a durable, fail-safe, and intimate electrical contact. A need exists for corresponding subsea connectors which avoid damage to the outer shielding layer due to relative movement of the different parts with respect to each other. A need exists for corresponding subsea connectors that avoid air entrapment during subsea operation.

This need is met by the features of the independent claims. The dependent claims define embodiments.

According to an aspect, a subsea connector is provided. The subsea connector comprises a housing. The housing has an inner surface and an outer surface. The inner surface forms a passage. The subsea connector further comprises a recess. The recess is arranged on the inner surface of the housing. The recess is configured to receive a canted coil spring such that it provides an electrical multi-point contact between an outer shielding layer of a subsea cable that is arranged in the passage and the housing. The subsea connector further comprises a link. The link is provided on the outer surface of the housing. The link is configured to releasably attach an earth link wire to the housing.

The electrical multi-point contact establishes electrical connections between the housing and the outer shielding layer at a plurality of positions on the perimeter of the subsea cable. E.g., the outer shielding layer can be a metallic or semi-conductive shielding layer. The outer shielding layer may be formed by a spiral of tinned copper wires. The outer shielding layer can be arranged outside with respect to a conductor at the core of the cable. The outer shielding layer may form an outer surface in at least some parts of the cable. It is also possible that in some parts of the subsea cable an additional cable jacket is arranged outside of the outer shielding layer. E.g., the housing can be a metallic housing.

By providing the recess that is configured to receive the canted coil spring, it is possible to provide the electrical multi-point contact via the canted coil spring in a dynamic fashion; i.e., allowing the subsea cable to expand and contract due to thermal expansion/contraction whilst maintaining electrical contact and preventing damage or degradation to the outer shielding layer.

The inner surface of the housing may be formed by a circular bore defining the passage. The recess may tangentially surround the circular bore. E.g., a center axis of the passage may be aligned or coinciding with a center axis of the recess. The recess may be circular shaped.

Generally, the dimensions and the shape of the passage can be flexibly adjusted. The design is scalable to accommodate larger and smaller subsea cables, single-, triad-, or multiconductor-subsea cables. The design is suitable to facilitate the electrical multi-point contact to outer shielding layers of various kinds and type. E.g., the design is suitable to establish the connection to outer shielding layers made out of metallic foil, copper tape, and/or of solid lead.

The housing may be integrally formed. Thus, the housing may be made substantially out of one piece. Thereby, a risk of air entrapments can be reduced. A stability may be increased.

Generally, the housing can be made of various materials. E.g., the housing may be made of steel and/or of copper. The material may be chosen so as to fulfill one or more requirements selected from the group comprising: conductivity requirements; electrical current requirements; and operating temperature requirements. Generally, the material may be chosen such that certain environmental performance requirements are met. E.g., copper provides a good robustness and, at the same time, is a good electrical conductor.

E.g., the link can have a threading which is configured to engage with a counterpart threading of the earth link wire. By providing the threading, an intimate contact which is robust against movements and other outer environmental influences can be provided between the earth link wire and the housing. Via the housing, electric connection between the earth link wire and the canted coil spring/the outer shielding layer can be provided. By employing a threaded link, it is possible to ensure an intimate contact between components.

Generally, the housing may be of arbitrary shape. In particular, it is possible that the inner surface of the housing and the outer surface of the housing are ring-shaped and coaxially aligned. In such a manner, a required building space for the housing and the subsea connector can be reduced. In particular, where there is a need of attaching earth link wires to a plurality of subsea cables in close vicinity, due to the small outer dimensions of the subsea connectors, it becomes possible to flexibly arrange the plurality of subsea cables with respect to each other. In particular, it may not be necessary to arrange the plurality of subsea cables in a splayed arrangement. It is possible to closely pack the subsea cables.

The subsea connector may further comprise a further link. The further link may be provided on an outer surface of the housing. The further link may be configured to releasably attach a tether piece such that at least one of rotational movement and linear movement of the housing with respect to the subsea cable is suppressed. Such rotational and/or linear movement may be caused by shock or vibration. E.g., the further link may have a threading configured to engage with a counterpart threading of the tether piece. Thereby, durable attachment can be achieved By providing the further link that is configured to releasably attach to the tether piece, a relative rotational and/or translational movement of the subsea connector with respect to the subsea cable can be suppressed. This allows increasing the stability and further prevents damage to the outer shielding layer due to the relative movement.

According to an aspect, a system is provided. The system comprises a first subsea connector and a second subsea connector. The system further comprises a first subsea cable and a second subsea cable. The first subsea connector comprises a housing having an inner surface and an outer surface. The inner surface forms a passage. The first subsea connector further comprises a recess arranged on the inner surface of the housing and configured to receive a canted coil spring such that it provides an electrical multi-point contact to an outer shielding layer of the first subsea cable. The first subsea cable is arranged in the passage formed by the inner surface of the housing of the first subsea connector. The first subsea connector further comprises a link. The link of the first subsea connector is provided on the outer surface of the housing of the first subsea connector and is configured to releasably attach an earth link wire to the housing. The second subsea connector comprises a housing having an inner surface and an outer surface. The inner surface forms the passage. The second subsea connector further comprises a recess arranged on the inner surface of the housing and configured to receive a canted coil spring such that it provides an electrical multi-point contact to an outer shielding layer of the second subsea cable. The second subsea cable is arranged in the passage formed by the inner surface of the housing of the second subsea connector. The second subsea connector further comprises a link. The link of the second subsea connector is provided on the outer surface of the housing of the second subsea connector and is configured to releasably attach and earth link wire to the housing.

E.g., the first subsea connector and the second subsea connector can be connected via the tether piece and corresponding first and second further links provided at the first subsea connector and the second subsea connectors, respectively.

The first and second subsea connectors can be configured corresponding to the subsea connector according to a further aspect.

According to a further aspect, a system is provided. The system comprises the subsea connector according to a further aspect. The system further comprises the canted coil spring arranged in the recess.

Employing a canted coil spring allows to reliably establish the electrical multi-point contact. Contraction and expansion of the subsea cable can be compensated for by the canted coil spring. Furthermore, friction between the subsea cable and the canted coil spring is comparably low such that wear out of the outer shielding layer due to potential relative movement of the canted coil spring within the recess with respect to the subsea cable is low. Damage and degradation of the outer shielding layer can be prevented.

By means of the recess, it becomes possible to reliably hold the canted coil spring captive—while, at the same time, the canted coil spring can deflect as required to maintain the electrical multi-point contact between the outer shielding layer and the housing.

The canted coil spring may project inwardly from the inner surface of the housing. E.g., the canted coil spring and the recess may be dimensioned correspondingly. By providing a corresponding clearance gap between the inner surface of the housing and the outer shielding layer, damage due to abrasion and friction between the inner surface of the housing and the outer shielding layer can be prevented.

It is possible that the canted coil spring is made out of copper or steel. Generally, the canted coil spring—as explained above with respect to the material of the housing—can be made of various materials that meet mechanical, electrical and/or environmental performance requirements. These requirements may include elements selected from the group comprising: conductivity requirements; electrical current requirements; and operating temperature requirements.

Generally, it is possible that the canted coil spring and the housing are made of the same material. Thereby, an intimate electrical multi-point contact between the housing and the outer shielding layer via the canted coil spring can be provided. It is also possible that the canted coil spring and the housing are made at least partially of different materials.

The system may further comprise the subsea cable. The subsea cable may be arranged in the passage such that it is at least partly enclosed by the inner surface of the housing.

The subsea cable has an outer surface formed by the outer shielding layer. The outer shielding layer may be in contact with the canted coil spring.

E.g., the subsea cable may have the following setup, from the center towards the outer surface: conductor—optionally, inner conductive layer—insulation—outer shielding layer—optionally, at least in some parts of the cable: cable jacket/sheath. It is possible that the cable jacket is not present at the position of the electrical multi-point contact.

Sometimes, the outer shielding layer may comprise two or more sublayers. E.g., an outer sublayer of the outer shielding layer may be referred to as the screen and may compensate dielectric stress, as explained above. E.g., an inner sublayer may be a conductive or semiconductive layer and may be referred to outer conductive layer—as it is arranged outwards of the inner conductive layer.

E.g., the conductor may be made of class 5 copper fine wire, tinned. E.g., the inner conductive layer may be made of a rubber compound and have a wall thickness of less than 1 mm, e.g., of 0.6 mm. E.g., the insulation may be made of rubber and have a wall thickness of more than 1 mm. E.g., the outer conductive sublayer of the outer shielding layer may be made of a rubber compound and may have a wall thickness of less than 1 mm, e.g., of 0.6 mm. The screen may be formed by a spiral of tinned copper wires. The cable jacket may be made of rubber.

According to a further aspect, a method is provided. The method comprises, above sea: attaching an end of an earth link wire to housing of a subsea connector. The housing has an inner surface and an outer surface. The inner surface forms a passage. The method further comprises, above sea: receiving a canted coil spring in a recess arranged on the inner surface of the housing. The method further comprises inserting a subsea cable into the passage to provide an electrical multi-point contact between the housing and an outer shielding layer of the subsea cable via the canted coil spring.

E.g., said inserting of the subsea cable into the passage may be executed above sea or subsea.

The method may further comprise above sea: attaching a further end of the earth link wire to Ground. E.g., the earth link wire can be attached to an interior of a housing of a subsea equipment; it is possible that an external connection is made to the exterior of the subsea equipment. Then the subsea equipment, together with the earth link wire, may be deployed at the subsea site.

Execution of such a method allows an easy assembly of the subsea system as most of construction can be carried out prior to installation of the subsea connector at the subsea site. In particular, various steps of the assembly can be executed above sea. There is a reduction in required components, a reduction in the risk of air entrapment, and a reduction in the amount of cable manipulation required during the assembly process if compared to reference implementations.

For a method according to the presently discussed aspect, effects may be achieved which are comparable to the effects that may be achieved for a subsea connector and the system according to further aspects of the present invention.

It is to be understood that the features mentioned above and those yet to be explained below may be used not only in the respective combinations indicated, but also in other combinations or in isolation without departing from the scope of the invention.

BRIEF DESCRIPTION OF THE DRAWINGS

The foregoing and additional features and effects of the invention will become apparent from the following detailed description when read in conjunction with the accompanying drawings, in which like reference numerals refer to like elements.

DETAILED DESCRIPTION

Figure 1:
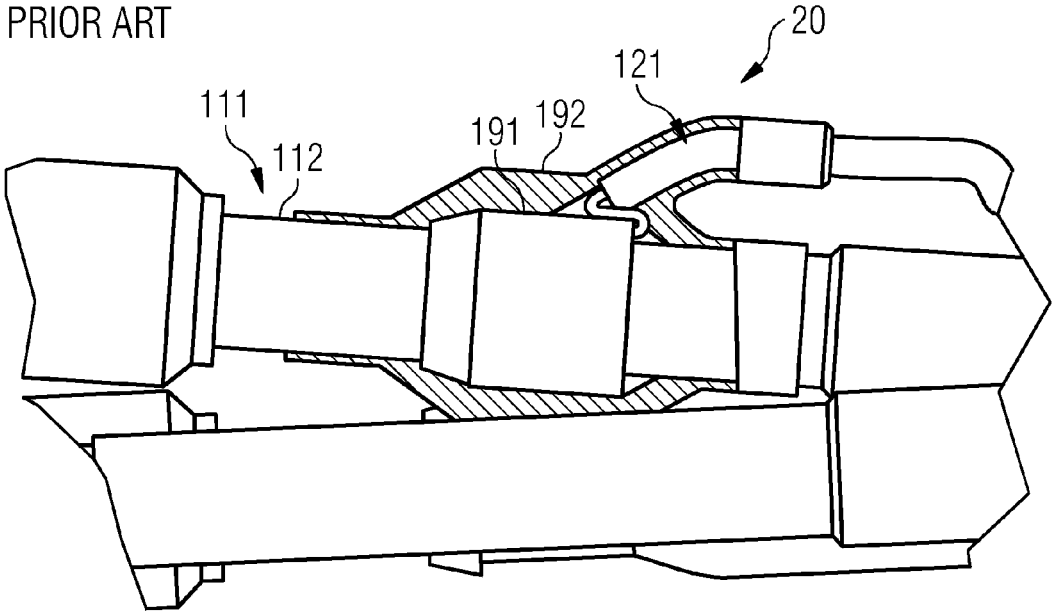
FIG 1 PRIOR ART
FIG. 1 illustrates a subsea connector according to reference implementations.
Figure 2:
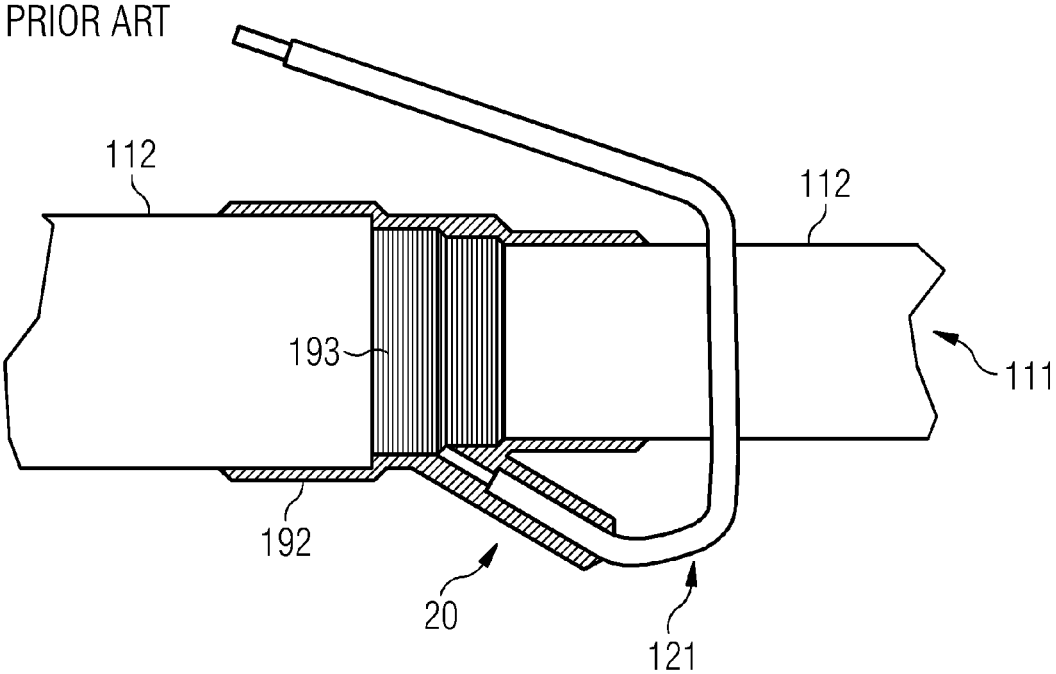
FIG 2 PRIOR ART
FIG. 2 illustrates a subsea connector according to reference implementations.

In the following, embodiments of the invention will be described in detail with reference to the accompanying drawings. It is to be understood that the following description of embodiments is not to be taken in a limiting sense. The scope of the invention is not intended to be limited by the embodiments described hereinafter or by the drawings, which are taken to be illustrative only.

The drawings are to be regarded as being schematic representations and elements illustrated in the drawings are not necessarily shown to scale. Rather, the various elements are represented such that their function and general purpose become apparent to a person skilled in the art. Any connection or coupling between functional blocks, devices, components, or other physical or functional units shown in the drawings or described herein may also be implemented by an indirect connection or coupling.

Hereinafter, techniques are discussed which enable to reliably establish an electrical connection between an earth link wire connected to Ground and an outer shielding layer (screen) of a subsea cable. These techniques rely on establishing an electrical multi-point contact via a canted coil spring.

Figure 3:
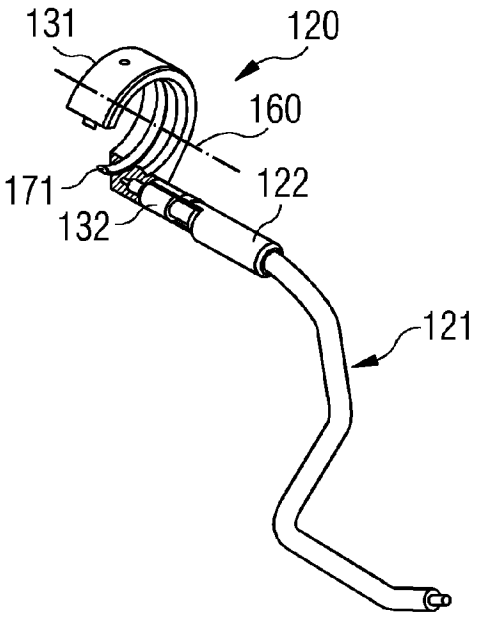
FIG. 3 is a perspective partial section view of a subsea connector according to various embodiments.

In FIG. 3, a perspective partial section view of the subsea connector 120 according to various embodiments is shown. The subsea connector 120 comprises a metallic housing 131. In the scenario of FIG. 3, the metallic housing 131 is made of copper and is of circular shape. Within the recess of the housing 131, a canted coil spring 171 is held captive. The housing 131 defines a passage 160 (a center axis of which is illustrated in FIG. 3 by the dashed line). It is possible to arrange a subsea cable (not shown in FIG. 3) in the passage.

Then, an electrical multi-point contact between the housing 131 and the screen of the subsea cable can be established via the canted coil spring 171.

As can be seen from FIG. 3, an earth link wire 121 is attached and electrically coupled to the housing 131 via a link 132. A protection sleeve 122 protects the earth link wire 121 against environmental influences in the vicinity of the link 132. The other end of the earth link wire 121 can be connected to Ground (not shown in FIG. 3).

Figure 4:
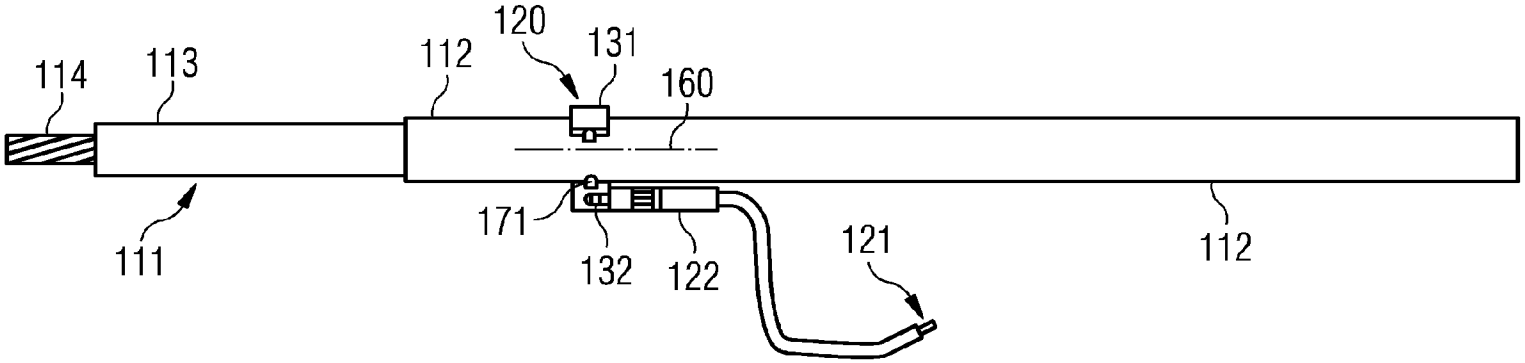
FIG. 4 is a perspective partial section view of a subsea connector according to various embodiments.

FIG. 4 is a perspective partial section view of the subsea connector 120 of FIG. 3 having a further perspective. In FIG. 4, the subsea cable 111 having the screen 112 is shown arranged inside the passage 160. As can be seen from FIG. 4, the canted coil spring 171 is in contact with the screen 112. The subsea cable 111 comprises an inner conductor 114 and an insulator 113 in-between the screen 112 and the inner conductor 114.

Figure 5:
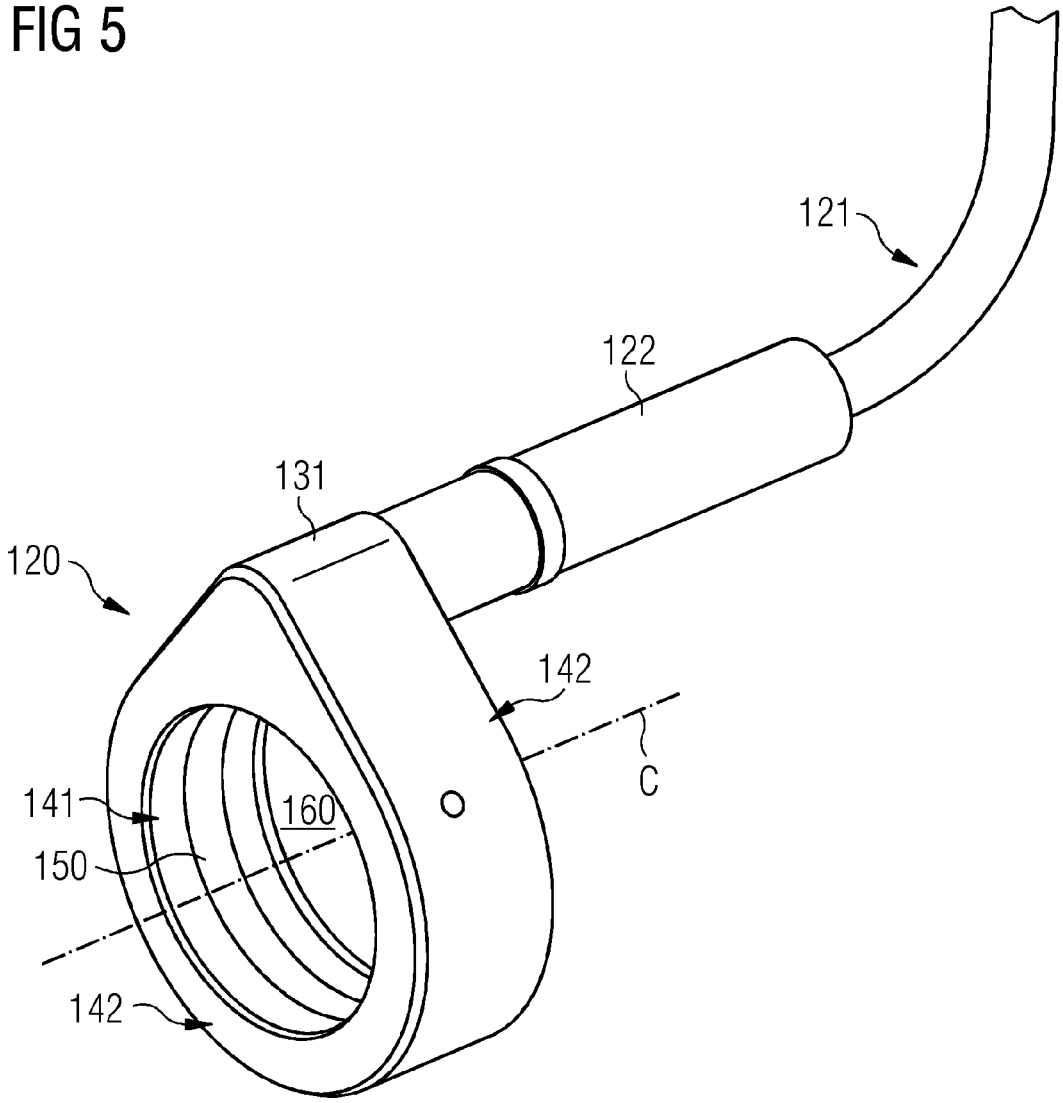
FIG. 5 is a perspective view of a subsea connector according to various embodiments.

FIG. 5 is a perspective view of the subsea connector 120. The earth link wire 121 is connected to the housing 131 having circular shape with a protrusion. As can be seen from FIG. 5, the housing 131 comprises an inner surface 141 and an outer surface 142. The inner surface 141 and the outer surface 142 are ring-shaped and are coaxially aligned with respect to a center axis C of the passage 160. In FIG. 5, the inner surface 141 of the housing 131 defines the passage 160. The inner surface 141 is formed by a circular bore. The recess 150 tangentially surrounds the circular bore and the center axis C. The housing 131 is integrally formed. By such a configuration of the subsea connector 120, air entrapments can be avoided. Further, the stability and rigidity of the subsea connector 120 is comparably large.

Figure 6:
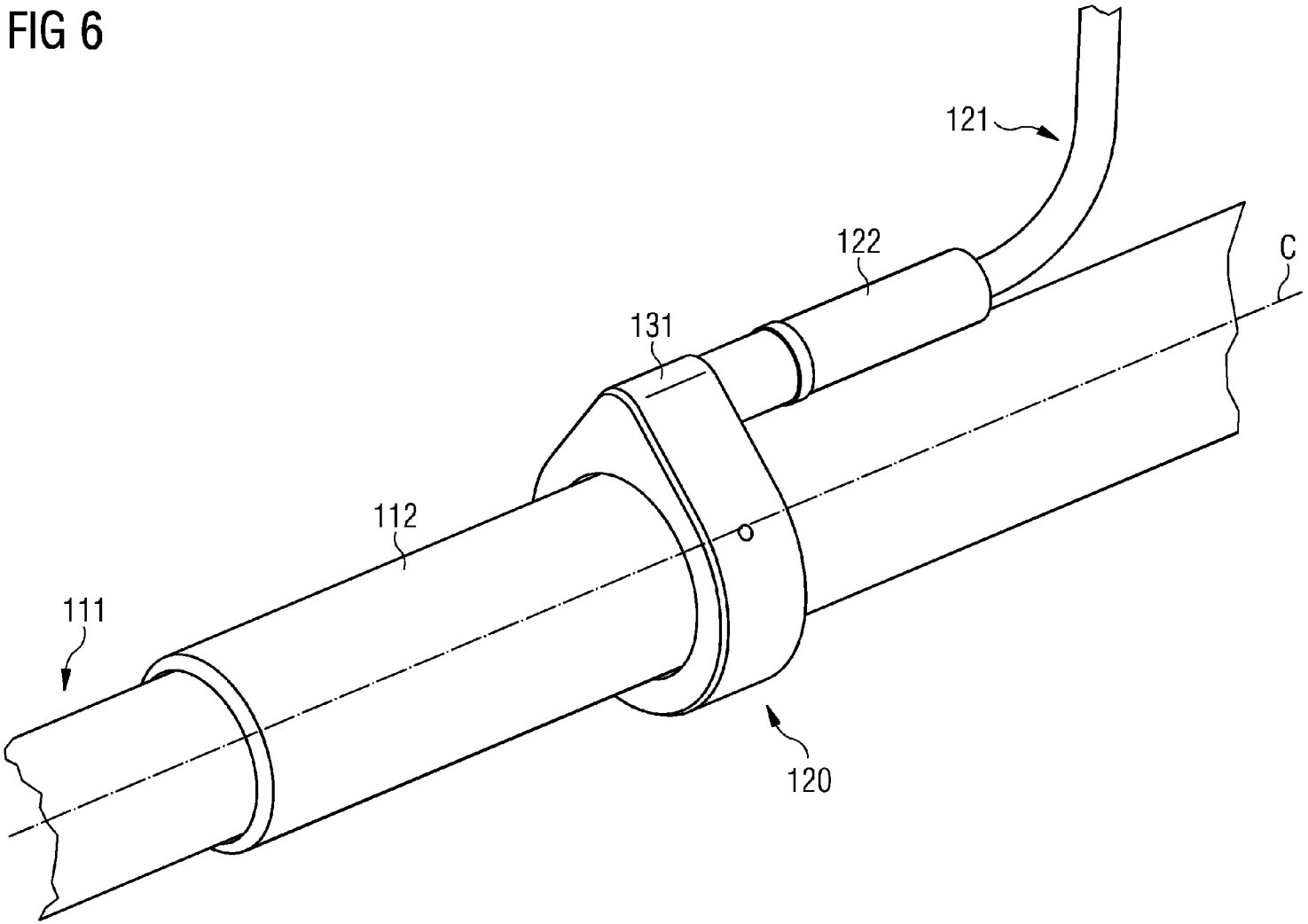
FIG. 6 is a perspective view of a subsea connector and a subsea cable having an outer shielding layer according to various embodiments.

FIG. 6 is a perspective view of the subsea connector 120 where the earth link wire 111 having the screen 112 forming its outer surface is arranged within the passage 160 formed by the inner surface 141 of the housing 131 of the subsea connector 120. As can be seen, the subsea cable 111 is in parallel to and aligned with the center axis C of the passage 160. The subsea cable 111 is fully enclosed by the inner surface 141 of the housing 131. Generally, it is not required that the inner surface 141 of the housing 131 fully encloses the subsea cable 111 to establish the multi-point electrical contact with the screen 112. E.g., the housing 131 can be formed as an open ring.

Figure 7:
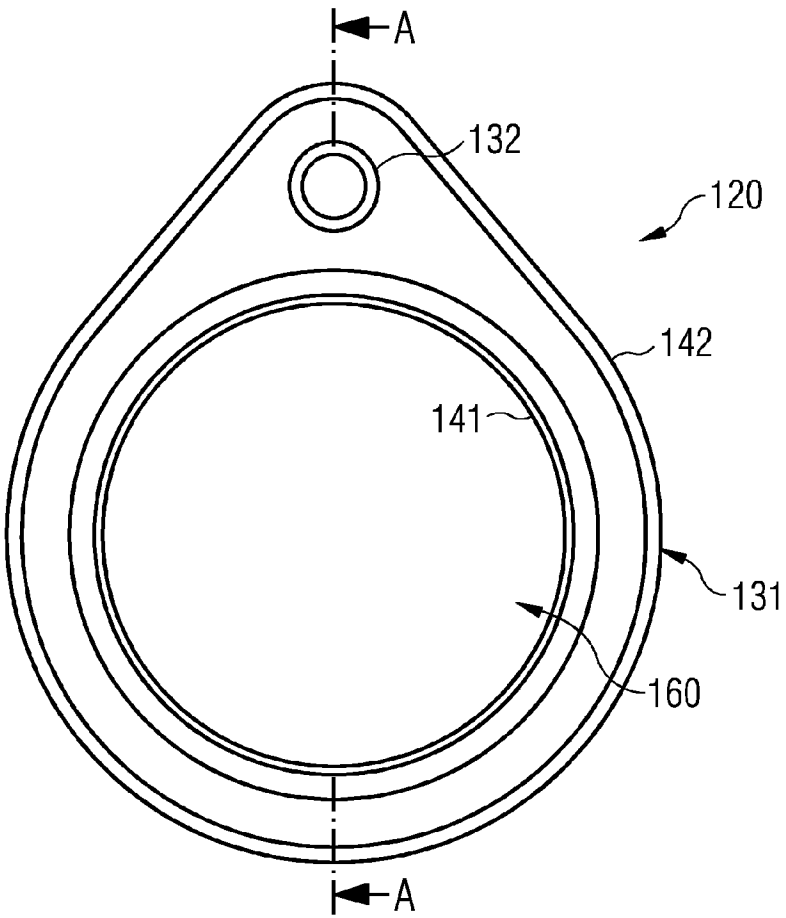
FIG. 7 is a front view of a subsea connector according to various embodiments.

FIG. 7 is a side view of the subsea connector 120. The link 132 is formed at the protrusion of the outer surface 142 of the housing 131; here, a wall thickness of the housing 131 is larger than in other parts more remote from the link 132. Specifically, the link 132 comprises a bore having a threading 132*a*, cf. FIG. 8. An axis of the bore of the link 132 is arranged in parallel to the center axis C of the passage 160. The threading 132*a* is configured to engage with a counterpart threading of the earth link wire 121 (not shown in FIG. 8).

Figure 8:
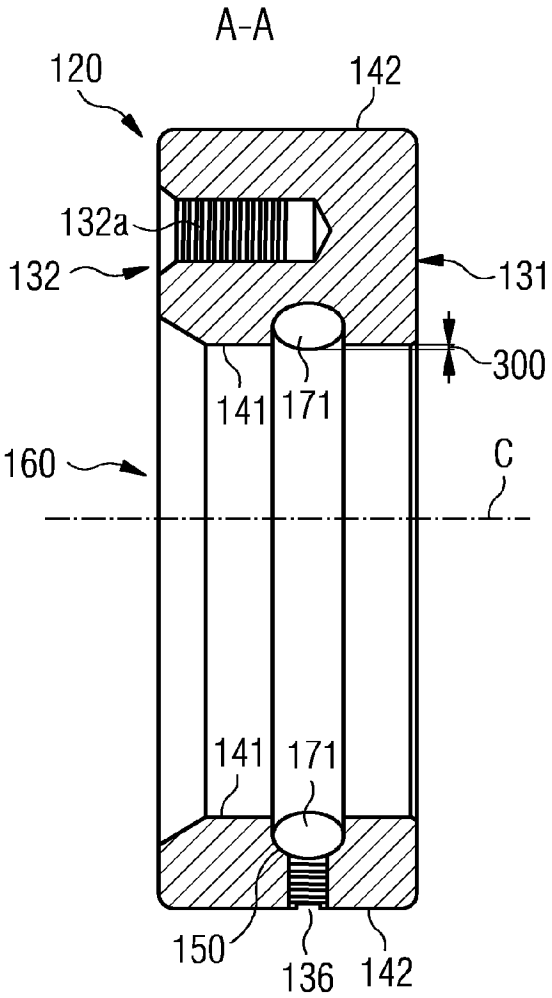
FIG. 8 is a side full section view of a subsea connector and a canted coil spring arranged in a recess of the subsea connector according to various embodiments.

In FIG. 8, the canted coil spring 171 is arranged in the recess 150. As can be seen from FIG. 8, the canted coil spring 171 projects inwardly from the inner surface 141 of the housing 131. Thereby, a gap 300 is maintained between the inner surface 141 and the screen 112 of the subsea cable 111 (not shown in FIG. 8). Thereby, friction and abrasion of the screen 112 due to relative rotation and/or translational movement of the subsea cable 111 with respect to the subsea connector 120 can be reduced.

In the scenario of FIG. 8, both, the housing 131 and the canted coil spring 171 are made of copper. Thus, generally, both the canted coil spring 171 and the housing 131 can be made out of the same material. Thereby, reliable and intimate electrical contact can be established between the screen 112 and the housing 131 via the canted coil spring 171. While with respect to the FIGs. examples have been explained where the material is copper, generally, the housing 131 and/or the canted coil spring 171 can be made at least partly of different materials such as steel, etc. In particular, depending on the particular requirements such as conductivity requirements, electrical current requirements and/or operating temperature requirements, a different material may be chosen.

In FIG. 8, the housing 131 further comprises a further link 136 having a threading. Via the further link 136, a tether piece (not shown in FIG. 8) can be releasably attached to the housing 131. Thereby, at least one of rotational movement and linear movement of the housing 131 with respect to the subsea cable 111 can be suppressed.

Figure 9:
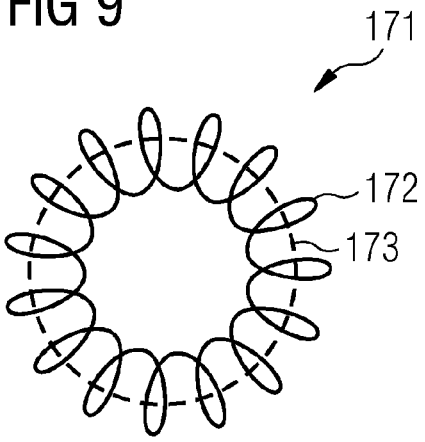
FIG. 9 schematically illustrates the canted coil spring.

In FIG. 9, the canted coil spring 171 is illustrated schematically. As can be seen, windings 172 of the canted coil spring 171 are wound about a center axis 173 of the canted coil spring 171. The center axis 173 is circularly shaped. Then, the center axis 173 can be tangentially aligned with respect to the center axis C of the passage 160 when the canted coil spring 171 is held captive in the recess 150 of the subsea connector 120.

The canted coil spring 171 reliably supports the electrical multi-point contact, but also provides the flexibility in order to absorb expansion and contraction of the subsea cable 111, e.g., due to changes in temperature, etc. Further, irregularities in the surface of the screen 112, e.g., local protrusions or indentations, can be compensated for.

Figure 10:
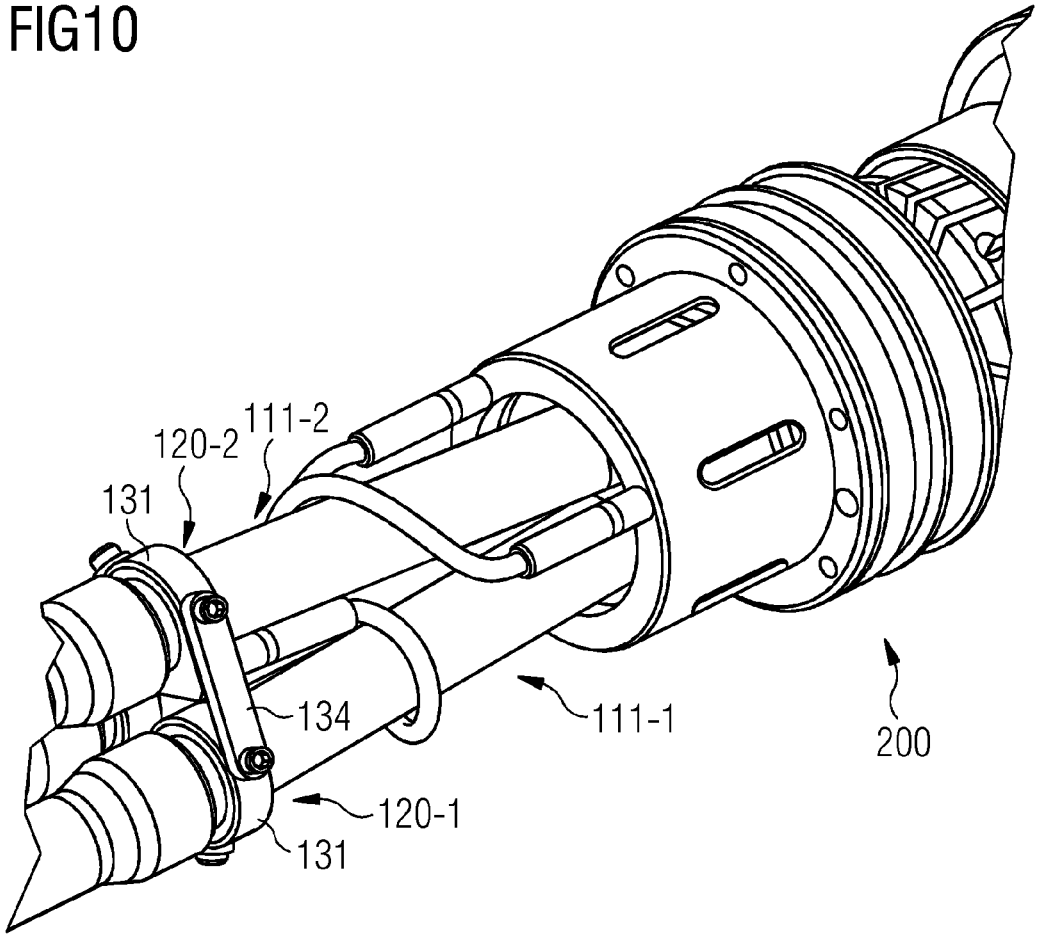
FIG. 10 is a perspective view of two subsea connectors coupled via a tether piece and of two subsea cables and of subsea equipment according to various embodiments.

Now referring to FIG. 10, the circular shape of the housing 131 enables closely packing a plurality of subsea cables 111-1, 111-2, e.g., when connecting to subsea equipment 200 through a shared port thereof. In FIG. 10, two adjacent subsea connectors 120-1, 120-2 are attached to each other via a tether piece 134. To attach to the tether piece 134, each one of the subsea connectors 120-1, 120-2 comprises the further link 136 on the outer surface 142 of the housing 131. As can be seen from FIG. 10, the small building space required for the housing 131 of the subsea connectors 120-1, 120-2 enables to arrange the subsea cables 111-1, 111-2 in close proximity to each other. In particular, it is not required to splay the subsea cables 111-1, 111-2 with respect to each other.

Figure 11:
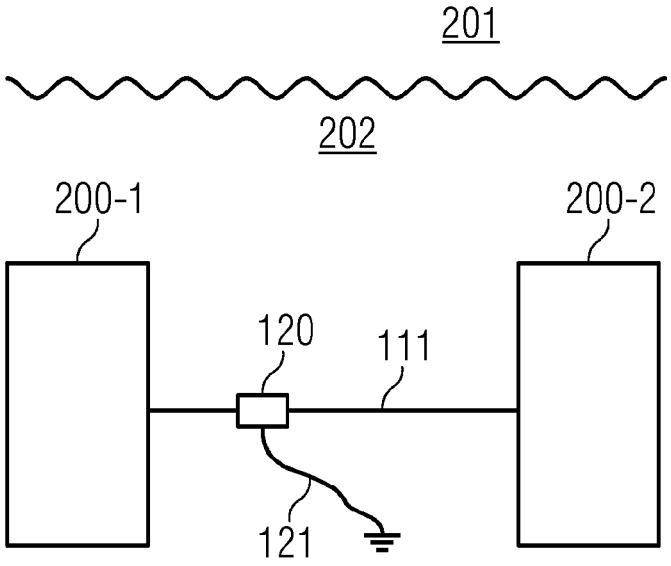
FIG. 11 illustrates subsea equipment connected via a subsea cable to which an earth link wire is connected employing a subsea connector according to various embodiments.

FIG. 11 schematically illustrates the first subsea equipment 200-1 and the second subsea equipment 200-2 arranged subsea 202. The first and second subsea equipment 200-1, 200-2 is connected via the subsea cable 111. The subsea connector 120 electrically connects the earth link wire 121 to the screen 112 (not shown in FIG. 11) of the subsea cable 111. Another end of the earth link wire 121 is connected to Ground.

When assembling the connection between the first and second subsea equipment 200-1, 200-2, some steps may be executed above sea 201, while other steps may be executed subsea 202. Employing the subsea connector 120 may bring the advantage of easy assembly as some of the construction may be carried out above sea 201 prior to installation of the connector 120 on the subsea cable 111.

Figure 12:
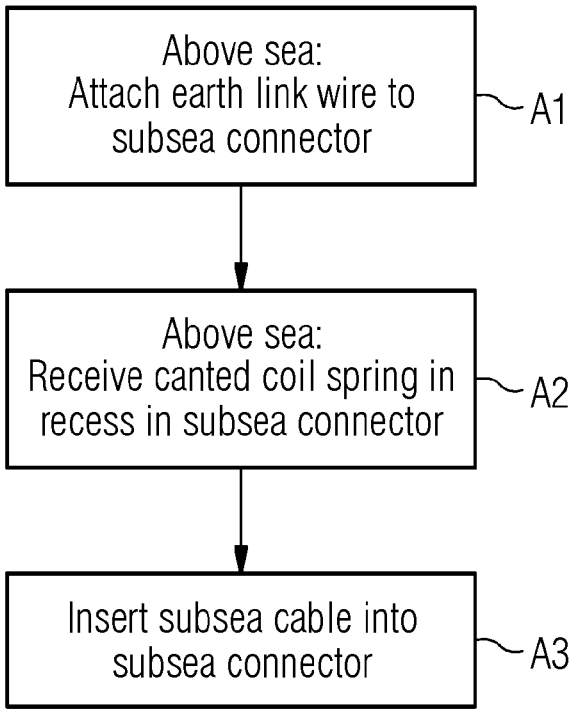
FIG. 12 is a flowchart of a method according to various embodiments.

In FIG. 12, a flowchart of a method according to various embodiments is illustrated. At A1, the earth link wire 112 is attached to the subsea connector 120. A1 is executed above sea 201. E.g., the earth link wire 112 can be attached to the housing 131 of the subsea connector 120 employing the threaded bore of the link 132 provided on the outer surface 142 of the housing.

At A2, the canted coil spring 171 is arranged in the recess 150 of the subsea connector 120. A2 is executed above sea 201. The recess 150 and the canted coil spring 171 can be dimensioned such that the gap 300 (cf. FIG. 8) is maintained once the subsea cable 111 is inserted into the passage 160 of the subsea connector 120, A3. A3 can be executed subsea 202 or above sea 201.

Optionally, the other end of the earth link wire 121 is attached to Ground, e.g., subsea 202. Ground connection can be established, e.g., by connecting the other end of the earth link wire 121 to the housing of subsea equipment 200, 200-1, 200-2.

Thus, summarizing, above techniques have been illustrated that enable to establish reliable and flexible electrical contact in between an earth link wire and a screen of a subsea cable. A canted coil spring is arranged such that it provides an electrical multi-point contact between a housing of a subsea connector and the screen of the subsea cable.

Although the invention has been shown and described with respect to certain preferred embodiments, equivalents and modifications will occur to others skilled in the art upon the reading and understanding of the specification. The present invention includes all such equivalents and modifications and is limited only by the scope of the appended claims.

The invention claimed is:

1. A subsea connector, comprising:
a housing having an inner surface and an outer surface, the inner surface forming a passage,
a recess arranged on the inner surface of the housing and configured to receive a canted coil spring,
a link provided on the outer surface of the housing and configured to releasably attach an earth link wire to the housing,
wherein when a subsea cable is arranged in the passage in the housing: the canted coil spring provides an electrical multi-point contact between an outer shielding layer of the subsea cable and the housing; and the inner surface, the recess, and the canted coil spring are configured to form an annular gap between the inner surface and the outer shielding layer of the subsea connector so that the inner surface and the outer shielding layer do not contact each other.

2. The subsea connector of claim 1,
wherein the inner surface of the housing is formed by a circular bore defining the passage, and
wherein the recess tangentially surrounds the circular bore.

3. The subsea connector of claim 1,
wherein the housing comprises a monolithic, annular body.

4. The subsea connector of claim 1,
wherein the housing is made of copper.

5. The subsea connector of claim 1,
wherein the link has a threading configured to engage with a counterpart threading of the earth link wire.

6. The subsea connector of claim 1,
wherein the inner surface of the housing and the outer surface of the housing are ring-shaped and coaxially aligned.

7. The subsea connector of claim 1, further comprising:
a further link provided on the outer surface of the housing and configured to releasably attach a tether piece such that at least one of rotational movement and linear movement of the housing with respect to the subsea cable is suppressed.

8. A system, comprising:
the subsea connector of claim 1,
wherein the canted coil spring is arranged in the recess.

9. The system of claim 8,
wherein the canted coil spring projects inwardly from the inner surface of the housing.

10. The system of claim 8,
wherein the canted coil spring is made of copper.

11. The system of claim 8,
wherein the canted coil spring and the housing are made of the same material.

12. The system of claim 8, further comprising:
the subsea cable arranged in the passage such that it is at least partly enclosed by the inner surface of the housing,
wherein the subsea cable comprises a cable outer surface formed by the outer shielding layer,
wherein the outer shielding layer is in contact with the canted coil spring.

13. A method, comprising:
above sea, attaching an end of an earth link wire to a housing of a subsea connector, the housing having an inner surface and an outer surface, the inner surface forming a passage,
above sea, receiving a canted coil spring in a recess arranged on the inner surface of the housing,
inserting a subsea cable into the passage,
wherein when the subsea cable is arranged in the passage in the housing: the canted coil spring provides an electrical multi-point contact between an outer shielding layer of the subsea cable and the housing; and the inner surface, the recess, and the canted coil spring are configured to form an annular gap between the inner surface and the outer shielding layer of the subsea connector so that the inner surface and the outer shielding layer do not contact each other.

14. The method of claim 13,
wherein said inserting of the subsea cable into the passage is executed above sea.

15. The method of claim 13, further comprising:
above sea, attaching a further end of the earth link wire to a ground.

16. The subsea connector of claim 5,
wherein the housing comprises a circular shape and a protrusion,
wherein the protrusion comprises a bore comprising the threading, and
wherein an axis of the bore is parallel to an axis of the passage.

17. The subsea connector of claim 16, further comprising the earth link wire comprising an end configured to thread into the threading.

18. A subsea connector, comprising:
a housing having an inner surface and an outer surface, the inner surface forming a passage,
a canted coil spring,
a recess arranged on the inner surface of the housing and configured to receive the canted coil spring such that the canted coil spring provides an electrical multi-point contact between an outer shielding layer of a subsea cable arranged in the passage and the housing, and
a link provided on the outer surface of the housing and configured to releasably attach an earth link wire to the housing,
wherein the link has a threading configured to engage with a counterpart threading of the earth link wire,
wherein the housing comprises a circular shape and a protrusion,
wherein the protrusion comprises a bore comprising the threading, and wherein an axis of the bore is parallel to an axis of the passage.

19. The subsea connector of claim 18, wherein the housing comprises a monolithic, annular body.

20. The subsea connector of claim 18, wherein the canted coil spring is arranged in the recess.

* * * * *